US006748859B2

(12) United States Patent
Goldburt et al.

(10) Patent No.: US 6,748,859 B2
(45) Date of Patent: Jun. 15, 2004

(54) SEPARABLE PRINTING PRESS INK CASSETTE ASSEMBLY AND METHOD

(75) Inventors: Mikhail Goldburt, St. Louis, MO (US); Dave Telken, St. Peters, MO (US)

(73) Assignee: Delaware Capital Formation, Inc., Wilmington, DE (US)

( * ) Notice: Subject to any disclaimer, the term of this patent is extended or adjusted under 35 U.S.C. 154(b) by 38 days.

(21) Appl. No.: 10/237,169

(22) Filed: Sep. 9, 2002

(65) Prior Publication Data

US 2004/0045462 A1 Mar. 11, 2004

(51) Int. Cl.[7] ..... B41F 31/00
(52) U.S. Cl. ..... 101/350.1; 101/367; 101/479
(58) Field of Search ..... 101/350.1, 350.6, 101/352.01, 367, 479, 182, 247, 216, 177

(56) References Cited

U.S. PATENT DOCUMENTS 4,774,883 A * 10/1988 Mailander ..... 101/247
5,178,678 A * 1/1993 Koehler et al. ..... 101/177
5,590,598 A * 1/1997 Keller ..... 101/479
5,794,531 A * 8/1998 Keller ..... 101/479
6,038,972 A * 3/2000 Delwiche et al. ..... 101/477
6,176,181 B1 * 1/2001 Van Ryzin et al. ..... 101/216
6,283,024 B1 * 9/2001 George ..... 101/182

* cited by examiner

*Primary Examiner*—Eugene H. Eickholt
(74) *Attorney, Agent, or Firm*—Foley & Lardner LLP

(57) ABSTRACT

An apparatus is provided which combines an interchangeable ink cassette assembly and a printing press drawer. The ink cassette which includes an ink pan, an anilox roll, and a meter roll may be removably attached to a printing press drawer such that the ink pan and the rolls can be removed as an integral unit from the printing press. Removal of the ink pan and rolls facilitates cleaning of the rolls and the pan. Further, a second assembly may quickly replace the removed assembly to reduce significantly the downtime of the press.

18 Claims, 5 Drawing Sheets

SEPARABLE PRINTING PRESS INK CASSETTE ASSEMBLY AND METHOD

BACKGROUND OF THE INVENTION

1. Field of the Invention

The present invention relates to the field of printing presses. More particularly, the invention relates to changing the ink used in printing presses and cleaning the components which come into contact with the ink before the ink can dry on those components.

2. Description of the Related Art

In a conventional printing press, anilox rolls, meter rolls, and ink pans all contact ink during normal press operation. However, because ink dries quickly, these components must be promptly cleaned after the press is stopped to prevent the ink from drying thereon. If the ink dries on the components, considerable effort and costly solvents are required to restore the components to their operational condition.

To facilitate the cleaning process, many presses are designed to have pull-out drawers which provide access to the ink pan and the rolls which contact the ink. Additionally, the components which contact the ink during press operation may be continuously wetted with ink to prevent the ink thereon from drying. The wetting of the components may be made possible, for example, by a constantly turning motor ("CT motor") mounted on the drawer which continuously turns the rolls in the ink pan to ensure that the ink on the rolls does not dry.

The possibility of the ink drying on the components is not the only drawback inherent in this conventional apparatus and method of cleaning it. In addition, if a user desires to replace the color or type of ink being used by a press, the press must be stopped and the components cleaned before the new color can be used therein. Accordingly, while the components are being cleaned the press remains idle. This downtime results in lost profits due to inefficient equipment utilization.

Another drawback is that although each of the components in the traditional press drawer may be individually removed from the press (to facilitate cleaning of each component parts), when a component is replaced, its position in the drawer must be properly aligned and adjusted with respect to the other components therein. This adjustment process takes additional time during which the press remains idle thereby exacerbating the downtime of the press and further reducing the press' productivity.

Thus, although a protocol exists for cleaning press components, the protocol suffers from various drawbacks. For these and other reasons, a new apparatus is needed which is easy to clean and which greatly reduces press downtime.

SUMMARY OF THE INVENTION

A first embodiment of the invention comprises an ink cassette assembly and a second embodiment of the invention comprises a printing press using an ink cassette assembly. The ink cassette assembly embodiment includes a frame, an ink pan which is positioned in a lower portion of said frame and which is adapted to hold ink, a meter roll, and an anilox roll. In this embodiment, the meter roll is rotatably connected to the frame, is positioned such that a portion of the meter roll sits within the pan, and is adapted to contact ink in the pan. The anilox roll, which is rotatably connected to the frame, has an outer surface which is in contact with an outer surface of the meter roll. The assembly is adapted to be removably connected to a drawer of a printing press such that the pan, the anilox roll, and the meter roll are removable from the printing press as an integral unit.

In a further embodiment, the assembly may be adapted to engage a CT motor for continuously rotating the anilox roll and/or the meter roll. In another embodiment, the assembly may include a mobile cart supporting the frame. In yet another embodiment, the assembly may include a doctor blade adapted to control an amount of ink on the outer surface of the anilox roll.

The printing press embodiment of the current invention includes a press body having a drawer therein, an ink cassette assembly, and a motor. The ink cassette assembly of the printing press includes a frame, an ink pan which is positioned in a lower portion of said frame and which is adapted to hold ink, a meter roll, and an anilox roll. The meter roll is rotatably connected to the frame and is positioned such that a portion of the meter rolls sits within the pan. The anilox roll is rotatably connected to the frame such that an outer surface of the anilox is in contact with an outer surface of the meter roll. The ink cassette assembly is adapted to be removably connected to the drawer of a printing press such that the pan, the anilox roll, and the meter roll are removable from the press body as an integral unit. The motor is adapted to turn the anilox roll such that the rotation of the anilox roll is adapted to cause a rotation of the meter roll. The rotation of the meter roll enables an outer surface thereof to rotate in the ink pan so that the outer surface of the meter roll is adapted to pick-up ink in the pan; the outer surface of the meter roll is adapted to transfer the ink thereon to the outer surface of the anilox roll.

A further embodiment of the printing press may include a transfer roll which is in contact with the anilox roll. In addition, another embodiment of the press may include a CT motor for continuously rotating the anilox roll and/or the meter roll. Further, yet another embodiment of the press may include a doctor blade which is adapted to control an amount of ink on the outer surface of the anilox roll.

The invention also provides a method of exchanging an ink pan, meter roll, and an anilox roll in a printing press. The method includes: (a) providing an assembly comprising: (i) a frame; (ii) an ink pan positioned in a lower portion of said frame, the ink pan adapted to hold ink; (iii) a meter roll rotatably connected to the frame, wherein the meter roll is positioned such that a portion of the meter roll sits within the pan, and wherein the meter roll is adapted to contact ink in the pan; and (iv) an anilox roll being rotatably connected to the frame, wherein an outer surface of the anilox roll is in contact with an outer surface of the meter roll; (b) withdrawing an insertion apparatus from an interior of printing press; (c) connecting the assembly to the insertion apparatus; and (d) returning the insertion apparatus with the assembly attached thereto to the interior of the printing press.

In the aforementioned method, the insertion apparatus may be a drawer. In addition, the method may also included: (e) adjusting the anilox roll with respect to a transfer roll in the printing press after the insertion is inserted into the interior of the printing apparatus. Additionally, or alternatively, the method may also include: (e) (of (f)) controlling an amount of ink on the outer surface of the anilox roll by means of a doctor blade. Further, the step of controlling an amount of ink on the outer surface of the meter roll may occur while the insertion is withdrawn from the interior of the printing apparatus. In addition, the step of controlling an amount of ink on the outer surface of the anilox roll may comprise adjusting the doctor blade.

These and other features, aspects, and advantages of the present invention will become more apparent from the following description, appended claims, and accompanying exemplary embodiments shown in the drawings.

BRIEF DESCRIPTION OF THE DRAWINGS

The accompanying drawings, which are incorporated in and constitute a part of the specification, illustrate an embodiment of the invention and together with the description, serve to explain the principles of the invention.

DETAILED DESCRIPTION OF THE PREFERRED EMBODIMENT

Figure 1:
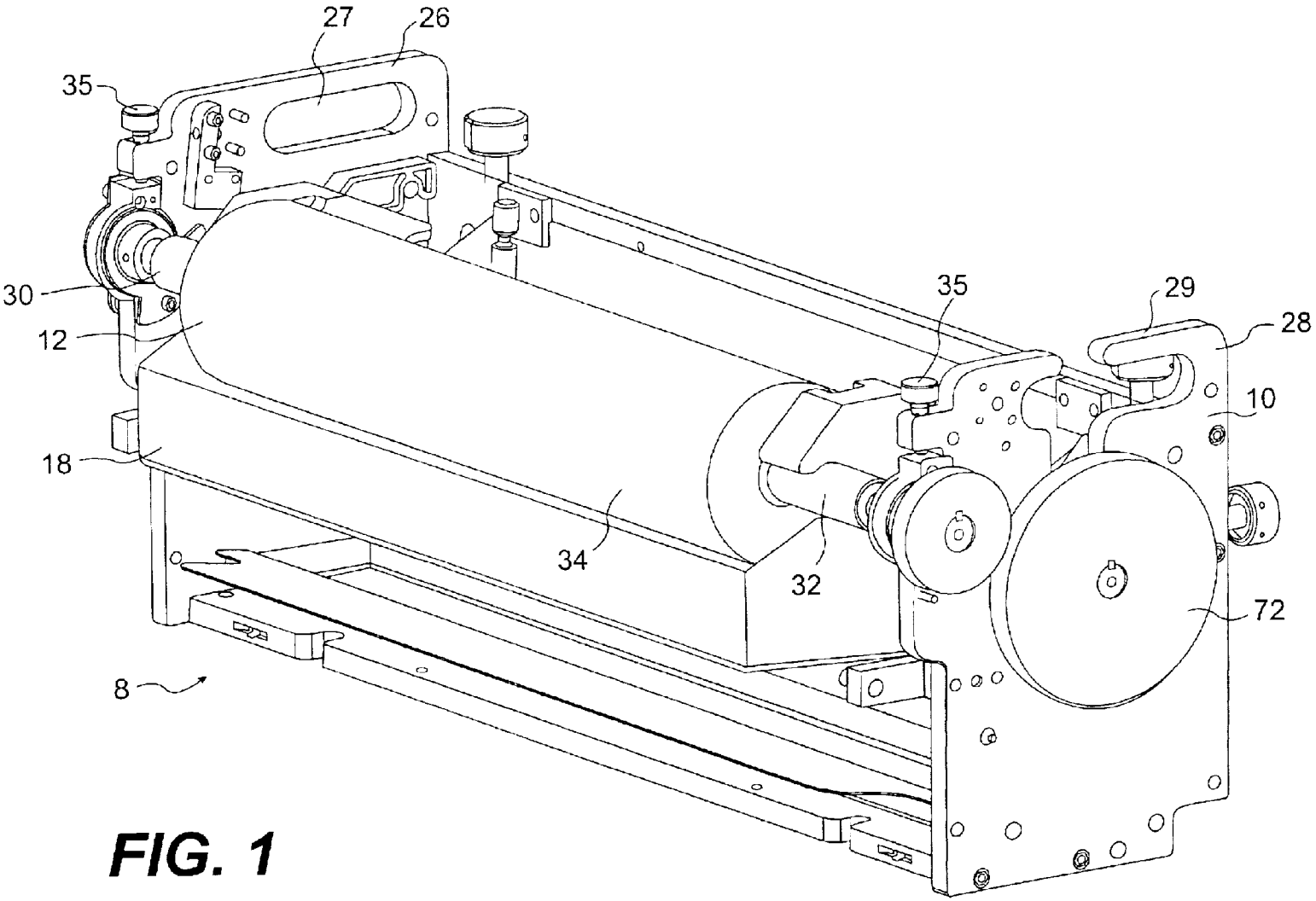
FIG. 1 is a frontal perspective view of a self-contained ink cassette assembly.

Reference will now be made in detail to a presently preferred embodiment of the invention, which is illustrated in the drawings. An effort has been made to use the same reference numbers throughout the drawings to refer to the same or like parts.

Figure 5:
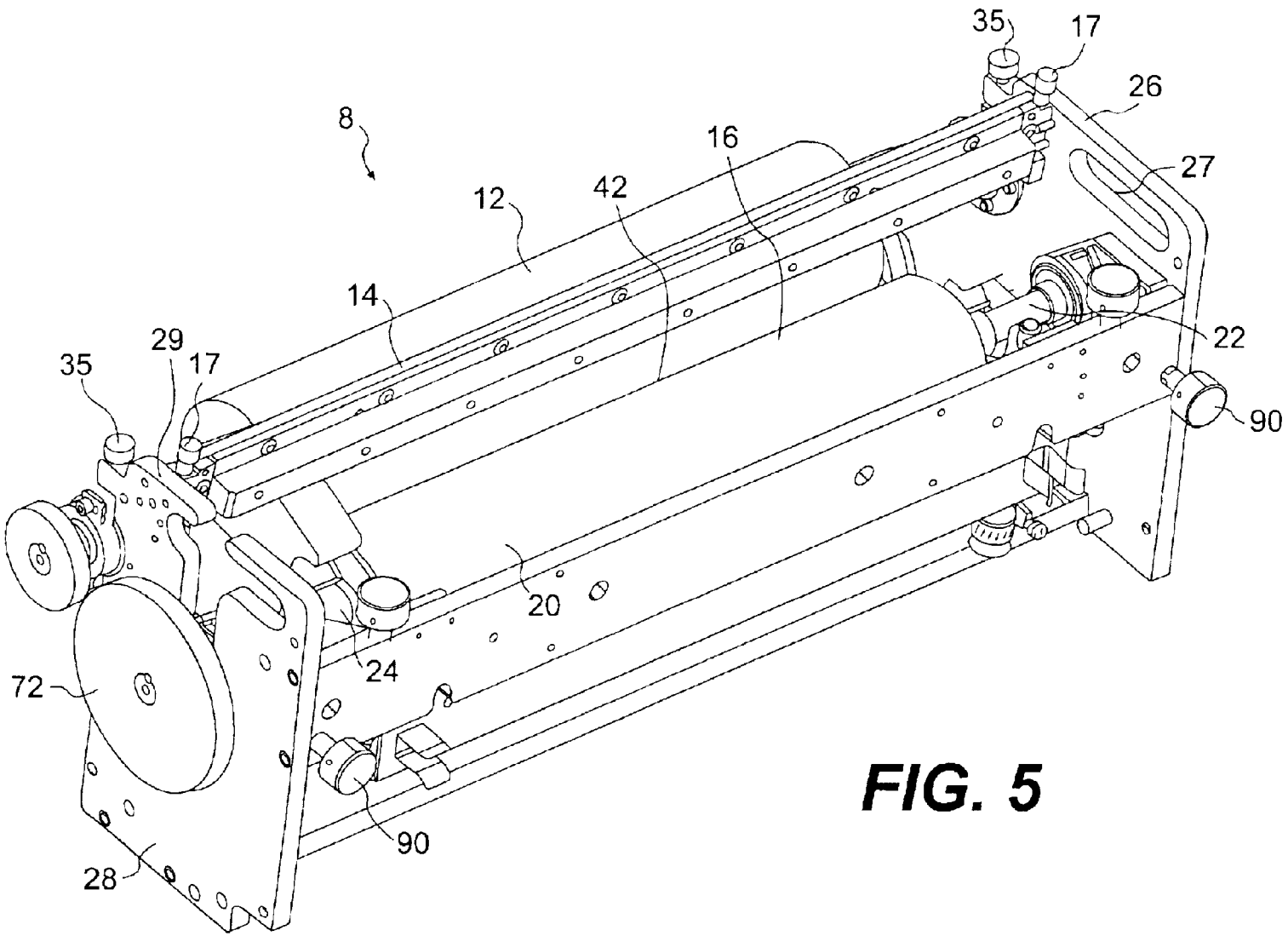
FIG. 5 is a rear perspective view of the assembly of FIG. 1 having the anilox and meter rolls positioned therein.

FIGS. 1 and 5 show perspective frontal and rear views of one embodiment of a self-contained ink cassette assembly 8 consistent with the present invention. The assembly includes a frame 10, an anilox roll 12, a meter roll 16, and an ink pan 18 which is adapted to hold fluid printing ink therein. Due to the weight of the anilox roll 12, the meter roll 16, and the ink pan 18, all of which are positioned in or connected to the frame 10, the frame 10 is preferably manufactured out of a high strength material such as steel so that the integrity of the frame 10 will remain intact when the assembly 8 is moved.

The meter roll 16 is positioned substantially parallel to the bottom of the ink pan 18 and sits such that at least a portion of it is disposed in the ink pan 18. If the ink pan 18 contains ink, the ink will be in contact with a cylindrical rolling surface 20 of the meter roll 16. Ends 22, 24 of the meter roll 16 are rotatably mounted to wall portions 26, 28, respectively, on opposite ends of the frame 10. Accordingly, when the meter roll 16 rotates, the cylindrical rolling surface 20 thereof is turned through the ink pan 18.

Ends 30, 32 of the anilox roll 12 are rotatably mounted to the wall portions 26, 28, respectively, of the frame 10 by turning knobs 35 which lock the anilox roll bearings into the frame 10. An outer cylindrical surface 34 of the anilox roll 12 is in contact with the outer cylindrical surface 20 of the meter roll 16 along a contact line 42. Accordingly, when the meter roll 16 turns in the ink pan 18 and picks-up ink therein, the ink is transferred to the outer cylindrical surface 34 of the anilox roll 12. The wall portions 26, 28 preferably have handle portions 27, 29 which facilitate lifting of the assembly 8.

After the anilox roll 12 and the meter roll 16 are mounted to the wall portions 26, 28, the pressure between the rolls can be adjusted using knobs 90 located on a back side of the assembly 8 (as shown in FIG. 5). When the anilox roll 12 and the meter roll are properly adjusted and the pressure therebetween is set at a desired level, the assembly 8 may be engaged with a CT motor (to drive the anilox roll 12) which is not part of a printing press.

The CT motor may be used in conjunction with a doctor blade 14 to scrape excess ink off of the outer surface 34 of the anilox roll 12, i.e., the doctor blade controls the amount of ink on the anilox roll 12. Further, the doctor blade 14 is adjustable via turning screws 17 on either end thereof. In addition, it should be noted that, the controlling of the amount of ink by the doctor blade may occur while the assembly 8 is not connected to a printing press 50.

As the pressure between the anilox and meter rolls 12, 16 can be adjusted external of the press 50, additional assemblies 8 can be prepared which are immediately ready to use when another assembly is removed from a press 50. In other words, a previously prepared assembly having properly adjusted anilox and meter rolls can be used immediately after being positioned on the press drawer 52 and inserted into the press 50 thereby further reducing the downtime of the press 50.

Figure 2:
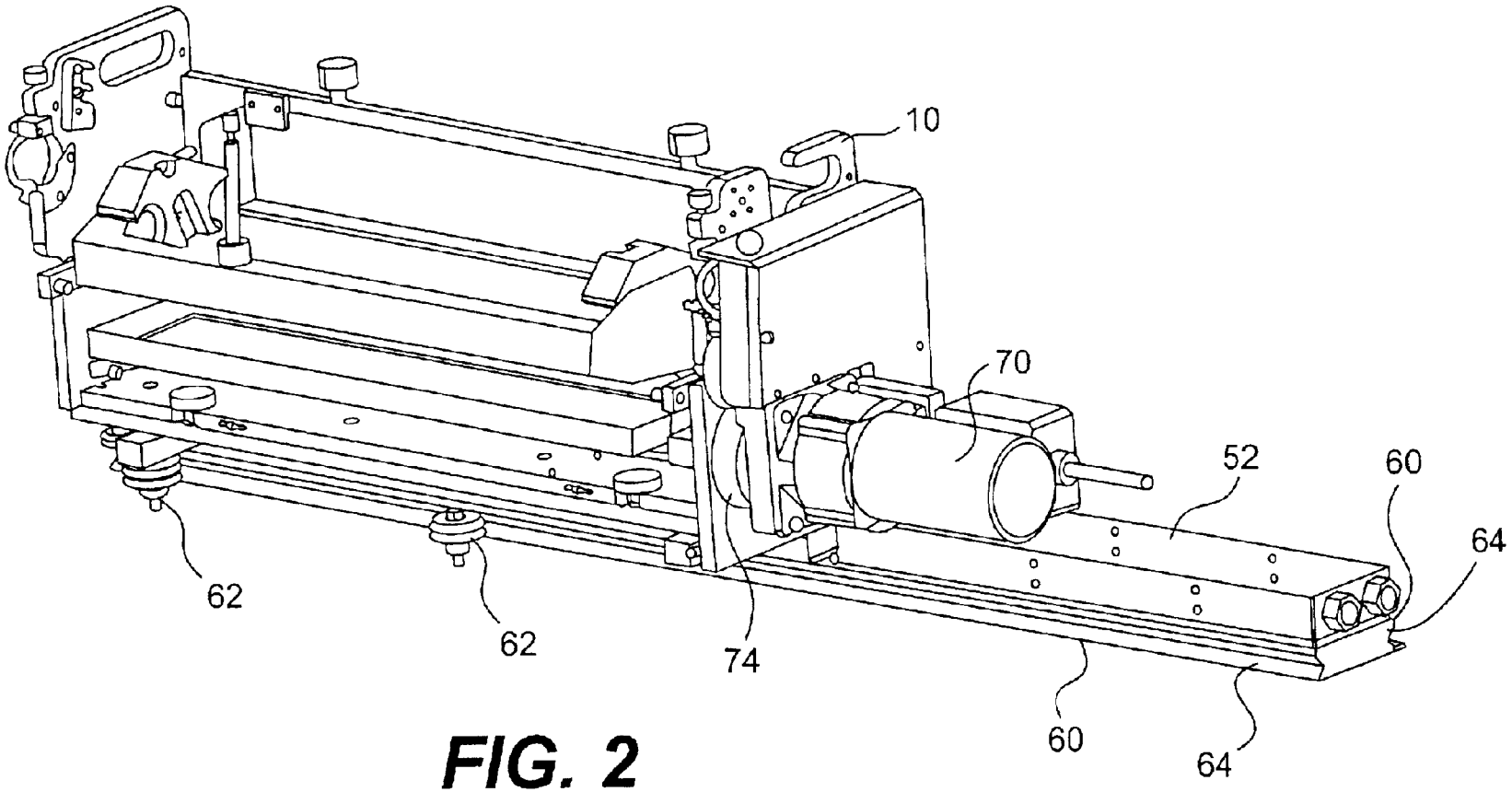
FIG. 2 is a perspective view of the self-contained ink cassette assembly of FIG. 1 installed on a printing press drawer having an anilox roll and the meter roll removed.
Figure 3:
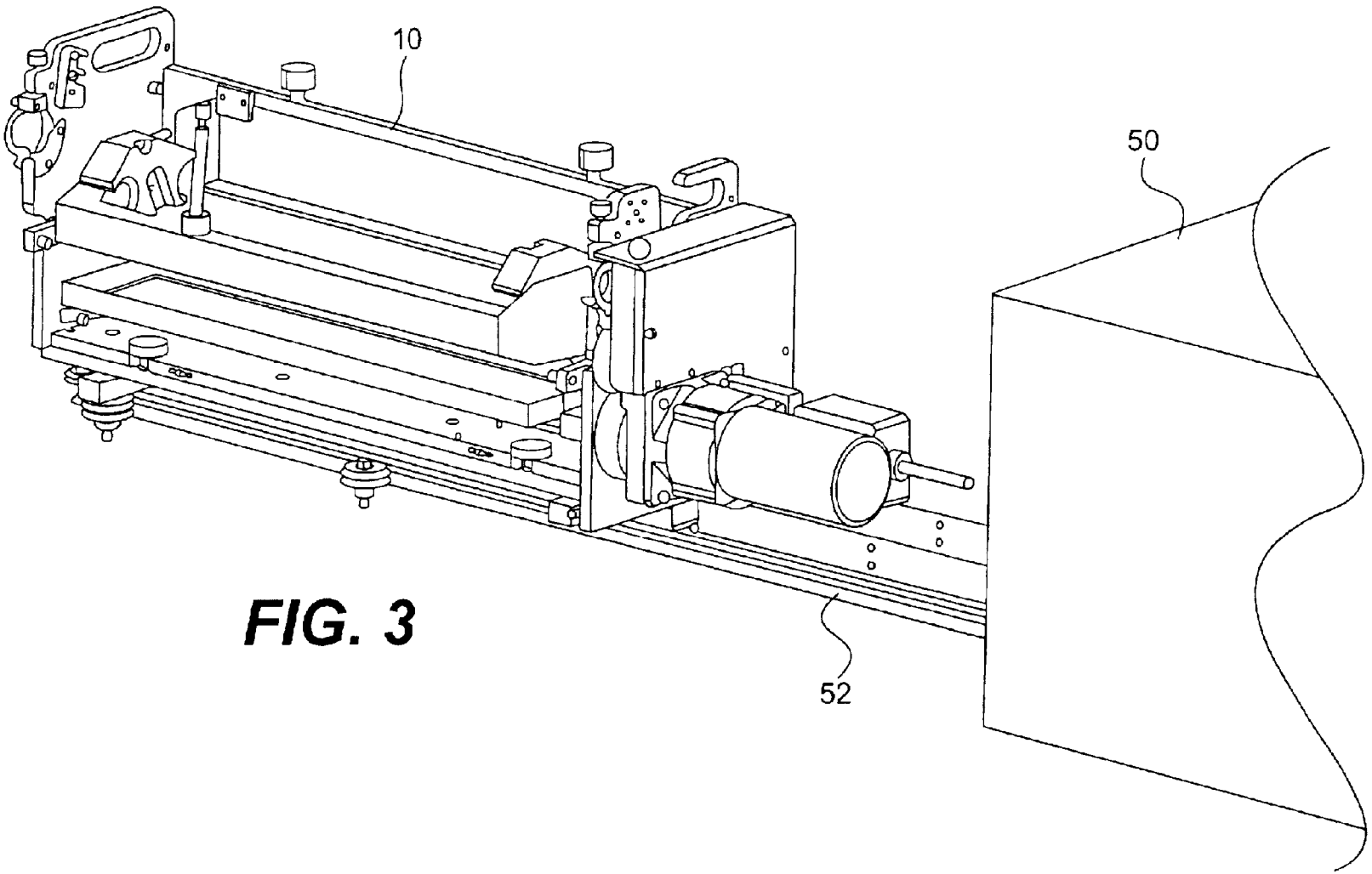
FIG. 3 is a perspective view of the self-contained ink cassette assembly and printing press drawer combination of FIG. 2 connected to a printing press.

The assembly 8 is adapted to be removably connected to an insertion apparatus, such as a drawer 52, of the printing press 50 (as shown in FIGS. 2 and 3) which provides easy access to the assembly 8. The drawer 52 slides out of the press along side rails 60. Further, the sliding of the rails 60 is facilitated by wheels 62 which are adapted to turn in channels 64 formed in the rails 60. Of course, alternative methods providing easy access to the assembly 8 could also be employed. For example, the assembly could be connected to a hinged door which swings into and out of a press.

Regardless of the method used to access the assembly 8, the ink pan 18, the anilox roll 12, and the meter roll 16 can be removed from the printing press 50 as an integral unit (as shown in FIG. 1). When the assembly 8 is positioned on the drawer 52, a gear 74 on a CT motor 70 positioned on the drawer 52 is adapted to engage a gear 72 on the frame 10. The motor 70 is adapted to rotate the anilox roll 12 which, in turn, rotates the meter roll 16 due to a geared engagement between the meter roll 16 and the anilox roll 12. Of course, when the meter roll 16 rotates, it will pick-up ink in the ink pan 18 and transfer it to the anilox roll 12.

It should be noted that when the assembly 8 is positioned on the drawer 52, the CT motor 70 is adapted to rotate the anilox roll irrespective of whether the drawer 52 is pushed into the press 50. This feature allows the operator to setup the ink cassette components even though the assembly is not pushed into the press, thereby permitting the current job to run while the subsequent job is being set-up.

When the assembly 8 is positioned in a printing press 50, the anilox roll 12 is adapted to be positioned such that its outer cylindrical surface 34 (which is in contact with the outer cylindrical surface 20 of the meter roll 16) is also in contact with an outer cylindrical surface of a conventional press transfer roll (not shown). Accordingly, when the anilox roll 12 is driven by the press motor 70 (such that the meter roll is correspondingly driven to pick-up ink in the ink pan 18), the ink transferred to the anilox roll is subsequently transferred to the transfer roll. Thereafter, the transfer roll transfers the ink to a piece of paper passing through the press 50 (as delivered by an impression roll) in the form of an image.

Unlike the ink pan 18, meter roll 16, and the anilox roll 12, the transfer roll of the printing press 50 does not need to have ink cleaned therefrom. Rather, the ink transferred to the transfer roll from the anilox 12 is removed by the paper in contact therewith. Accordingly, to remove the ink on the transfer roll, the transfer roll is disengaged from the anilox roll 12 by removing the ink cassette assembly 8 from the press drawer 52. Subsequently, the transfer roll is continuously rotated against paper being passed through the press 50, until the ink is fully transferred to the paper.

As a result of the invention previously described, the downtime of the press 50 is substantially reduced over the prior art. Specifically, the assembly 8 (hereinafter the "first assembly 8") can be removed from the drawer 52, the transfer roll quickly cleaned by transferring the remaining ink thereon onto paper passing through the press, and a second assembly 8, which may have a different color ink (in the ink pan 18) than the first assembly 8, can be inserted into the press 50. Accordingly, the press 50 may be operated with the second assembly 8 while the ink pan 18, anilox roll 12, and meter roll 16 of the first assembly 8 are being cleaned. Accordingly, the productivity of the press 50 is improved by the separable ink cassette assembly 8 of the present invention.

In addition, further improvements to the press productivity are also made possible by the present invention. Specifically, unlike conventional presses in which the anilox and meter rolls have to be properly adjusted upon being replaced in the press, the adjustment of the anilox and meter rolls 12, 16 of the present invention can occur external to the press 50 because the adjustment occurs relative to the frame 10 of the assembly 8.

Improvements to the press productivity are not the only benefits of the present invention. In addition, the ink pan 18, anilox roll 12, and meter roll 16 of each assembly unit 8 of the present invention are easier to clean than their conventional counterparts. Specifically, as the assembly units 8 are easily removable from the press 50, the accessibility of each of the ink pan 18, anilox roll 12, and meter roll 16 is greatly increased.

Figure 4:
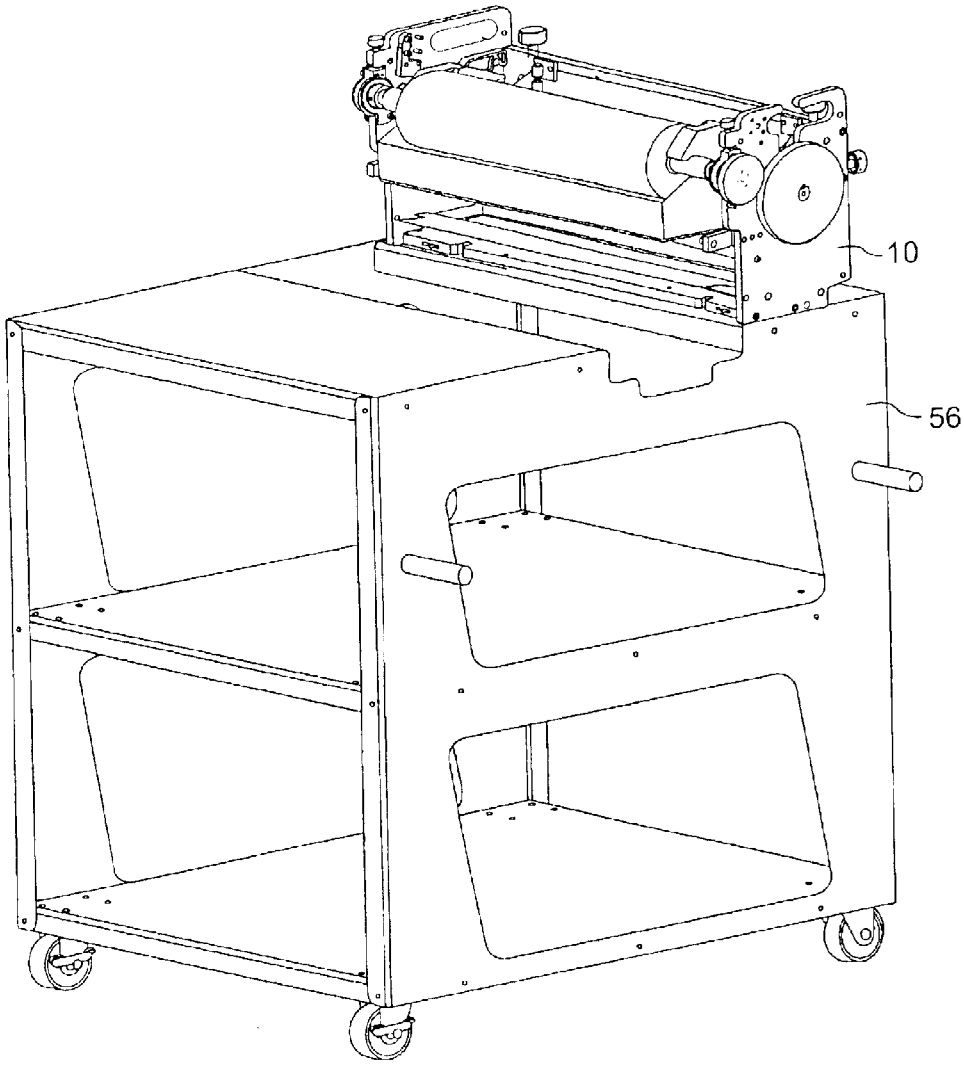
FIG. 4 is a perspective view of the self-contained ink cassette assembly of FIG. 1, the assembly being supported by a cart.

Although the aforementioned describes preferred embodiments of the invention, the invention is not so restricted. It will be apparent to those skilled in the art that various modifications and variations can be made to the disclosed preferred embodiments of the present invention without departing from the scope or spirit of the invention. For example, the CT motor 70 positioned on the drawer could be incorporated into the assembly 8. Moreover, the assembly 8 or the drawer 52 could additionally include a CT motor for the meter roll 16. By way of another example, due to the weight of the assembly 8, a cart 56 (as shown in FIG. 4) could be provided to support an assembly so that it could be wheeled to a press drawer 52 and automatically engaged therewith.

Accordingly, it should be understood that the embodiments described herein are illustrative only and are not limiting upon the scope of the invention, which is indicated by the following claims. Accordingly, alternatives which would be obvious to one of ordinary skill in the art upon reading the teachings herein disclosed, are hereby within the scope of this invention.

What is claimed is:

1. An ink cassette assembly adapted to be used in a printing press, the assembly comprising:

a frame;

an ink pan positioned in a lower portion of said frame, the ink pan adapted to hold ink;

a meter roll rotatably connected to the frame, wherein the meter roll is positioned such that a portion of the meter roll sits within the pan, and wherein the meter roll is adapted to contact ink in the pan; and an anilox roll being rotatably connected to the frame, wherein an outer surface of the anilox roll is in contact with an outer surface of the meter roll, wherein the assembly is adapted to be removably connected to a drawer of a printing press such that the pan, the anilox roll, and the meter roll are removable from the printing press as an integral unit.

2. The ink cassette assembly according to claim 1, wherein the assembly is adapted to engage a CT motor for continuously rotating the anilox roll.

3. The ink cassette assembly according to claim 1, wherein the assembly is adapted to engage a CT motor for continuously rotating the meter roll.

4. The ink cassette assembly according to claim 3, wherein the assembly is adapted to engage a CT motor for continuously rotating the anilox roll.

5. The ink cassette assembly according to claim 1, further comprising:

a mobile cart supporting the frame.

6. The ink cassette assembly according to claim 1, further comprising:

a doctor blade adapted to control an amount of ink on the outer surface of the anilox roll.

7. A printing press comprising:

a press body having a drawer therein;

an ink cassette assembly comprising:

a frame;

an ink pan positioned in a lower portion of said frame, the ink pan adapted to hold ink;

a meter roll rotatably connected to the frame, wherein the meter roll is positioned such that a portion of the meter rolls sits within the pan; and an anilox roll being rotatably connected to the frame, wherein an outer surface of the anilox is in contact with an outer surface of the meter roll; and a motor, wherein the ink cassette assembly is adapted to be removably connected to the drawer such that the pan, the anilox roll, and the meter roll are removable from the press body as an integral unit, wherein the motor is adapted to turn the anilox roll, wherein the rotation of the anilox roll is adapted to cause a rotation of the meter roll so that the outer surface of the meter roll rotates in the ink pan so that the outer surface of the meter roll is adapted to pick-up ink in the pan, and wherein the outer surface of the meter roll is adapted to transfer the ink thereon to the outer surface of the anilox roll.

8. The printing press of claim 7, further comprising:

a transfer roll which is in contact with the anilox roll.

9. The printing press according to claim 7, further comprising:

a CT motor for continuously rotating the anilox roll.

10. The printing press according to claim 7, further comprising:

a CT motor for continuously rotating the meter roll.

11. The printing press according to claim 10, further comprising:

a CT motor for continuously rotating the anilox roll.

12. The printing press according to claim 10, wherein the assembly further comprises:

a doctor blade adapted to control an amount of ink on the outer surface of the anilox roll.

13. A method of exchanging an ink pan, meter roll, and an anilox roll in a printing press comprising the steps of:

providing an assembly comprising:

a frame;

an ink pan positioned in a lower portion of said frame, the ink pan adapted to hold ink;

a meter roll rotatably connected to the frame, wherein the meter roll is positioned such that a portion of the meter roll sits within the pan, and wherein the meter roll is adapted to contact ink in the pan; and an anilox roll being rotatably connected to the frame, wherein an outer surface of the anilox roll is in contact with an outer surface of the meter roll;

withdrawing an insertion apparatus from an interior of printing press;

connecting the assembly to the insertion apparatus; and returning the insertion apparatus with the assembly attached thereto to the interior of the printing press.

14. The method according to claim 13, wherein the insertion apparatus is a drawer.

15. The method according to claim 13, further comprising the step of:

adjusting the anilox roll with respect to a transfer roll in the printing press after the insertion apparatus is inserted into the interior of the printing apparatus.

16. The method according to claim 13, further comprising the step of:

controlling an amount of ink on the outer surface of the anilox roll by means of a doctor blade.

17. The method according to claim 16, wherein the step of controlling an amount of ink on the outer surface of the anilox roll occurs while the insertion apparatus is withdrawn from the interior of the printing apparatus.

18. The method according to claim 16, wherein the step of controlling an amount of ink of the outer surface of the anilox roll comprises:

adjusting the doctor blade.

* * * * *